US005957012A

United States Patent [19]

McCune

[11] Patent Number: 5,957,012

[45] Date of Patent: Sep. 28, 1999

[54] DEVICE AND METHOD FOR IDENTIFYING A TOOL SOCKET

[76] Inventor: John E. McCune, 443 North Rd., Bedford, Mass. 01730

[21] Appl. No.: 08/601,338

[22] Filed: Feb. 16, 1996

[51] Int. Cl.[6] ..... B25B 13/58

[52] U.S. Cl. ..... 81/180.1; 81/185; 81/DIG. 5

[58] Field of Search ..... 81/180.1, DIG. 5, 81/21, 25, 124.6, DIG. 11, 185, 310, 311; D8/29, 230, 215; 215/355, 121.1; 40/913

[56] References Cited

U.S. PATENT DOCUMENTS

| | | | |
|---|---|---|---|
| 451,137 | 4/1891 | Schroeder | 215/230 |
| 3,875,829 | 4/1975 | Evans et al. | 81/185 |
| 4,800,786 | 1/1989 | Arnold et al. | 81/180.1 |
| 4,836,067 | 6/1989 | Rogers et al. | 81/185 |
| 4,979,355 | 12/1990 | Ulevich | 81/DIG. 11 |
| 4,982,627 | 1/1991 | Johnson | 81/DIG. 5 |
| 5,031,488 | 7/1991 | Zumeta | 81/180.1 |
| 5,361,656 | 11/1994 | Starr | 81/180.1 |
| 5,421,224 | 6/1995 | Bond | 81/DIG. 5 |

FOREIGN PATENT DOCUMENTS

| | | | |
|---|---|---|---|
| 14483 | 6/1912 | United Kingdom | 215/230 |

*Primary Examiner*—David Scherbel
*Assistant Examiner*—Joni B. Danganan
*Attorney, Agent, or Firm*—Wolf, Greenfield & Sacks, P.C.

[57] ABSTRACT

A device and method is provided for identifying a set of tool sockets. In one embodiment of the invention, the device includes a body that is adapted to be mated with a tool socket, and an identifier disposed on the body to identify the tool socket. The body includes a first portion that is adapted to be inserted into the tool socket, and a second portion that is adapted to protrude from the tool socket when the first portion is inserted into the tool socket. The identifier is disposed on the second portion and is viewable when the first portion is inserted into the tool socket. A plurality of socket plugs of various sizes can be provided for identifying each tool socket in a set of tool sockets. A socket plug corresponding in size to each tool socket is selected and inserted into the tool socket to identify the particular socket.

21 Claims, 1 Drawing Sheet

DEVICE AND METHOD FOR IDENTIFYING A TOOL SOCKET

BACKGROUND OF THE INVENTION

1. Field of the Invention

The present invention relates to a device and method for identifying a tool socket. More particularly, the present invention relates to a device that can be mated with the tool socket so that an identifier is viewable when the device is mated with the tool socket, and to a method for using the device to identify the tool socket.

2. Discussion of the Related Art

A socket wrench is a commonly-used tool that includes a wrench handle and a plurality of tool sockets that are adapted respectively to fit various head sizes of bolts, nuts, and like fasteners. Such fasteners can be loosened or tightened by rotating the appropriate tool socket with the tool handle. An advantage of using a socket tool is the ability of a user to interchange a plurality of tool sockets of various sizes so that the user can fasten or unfasten nuts and bolts of various sizes using a single or minimal number of wrench handles.

Conventionally, a socket wrench set includes a wrench handle having a particular drive size and a set of tool sockets adapted for use with the particular drive size of the handle. The set of tool sockets includes a plurality of sockets having a range of sizes that provide the user with the flexibility of interchanging tool sockets on the wrench handle to fit the head of the fastener being worked on in a particular situation. A set of tool sockets generally includes sockets configured for use with fasteners having U.S. customary units (e.g., inches), metric units (e.g., millimeters) or a combination of both units. Sockets are also provided with different depths to fit over fasteners having various heights. Sockets are generally configured as either a 6-point or 12-point socket, each being used with hexagonally shaped fasteners.

When using a socket wrench, the user selects the tool socket having the proper size for the particular application. In this regard, a problem frequently encountered with using the socket wrench is the inability of the user to easily identify the proper socket for the particular application. Conventionally, the size of each socket is indicated on the side of the socket body. However, the location of the size identification on the side of the socket body makes it difficult for a user to easily identify the proper socket size. In particular, the user generally must pick up individual sockets and rotate each socket body to read its size until the desired socket is located. The print on the sockets is generally small and may become difficult to read as the sockets become worn and/or dirty. This process becomes even more cumbersome when tool sockets are randomly scattered on a surface or in a container or when operating in a poorly lit environment. The difficulty in identifying individual sockets is compounded when the set of sockets includes sockets configured in U.S. as well as metric units, and sockets configured for use with socket drives of different sizes. Therefore, a need exists for a device which allows a user to more easily identify the size of individual tool sockets.

SUMMARY OF THE INVENTION

In accordance with the above, the invention provides a device for identifying a tool socket, and a method for identifying a set of tool sockets of various sizes.

According to one aspect of the invention, a device for identifying a tool socket comprises a body including a first portion and a second portion, and an identifier disposed on the second portion. The first portion is adapted to be inserted into the tool socket, and the second portion is adapted to protrude from the tool socket when the first portion is inserted into the tool socket. The identifier is viewable when the first portion is inserted into the tool socket.

In illustrative embodiments of the invention, the identifier includes a number that corresponds to the size of the tool socket. The identifier can be arranged to identify the size of the tool socket in inches and millimeters.

In other illustrative embodiments of the invention, the first portion has a hexagonal cross-sectional shape. The cross-sectional size of the first portion can be substantially equal to the size of the tool socket. The first portion can also be sized to create an interference fit between the first portion and the tool socket so that the device is retained in the socket.

In further illustrative embodiments of the invention, the device includes a flange disposed between the first portion and the second portion, and the second portion is adapted to be inserted into the tool socket. The first portion and the second portion each can have a hexagonal cross-section, wherein the cross-sectional size of the first portion is equal to the cross-sectional size of the second portion, or the cross-sectional size of the first portion is different from the cross-sectional size of the second portion.

According to another aspect of the invention, a set of socket plugs identifies a set of tool sockets of various sizes. The set of socket plugs include a plurality of socket plugs, each of which is adapted to be mated with a corresponding tool socket. The socket plug includes an identifier corresponding to the size of the tool socket. The plurality of socket plugs includes a first group having a first color and a second group having a second color. In one embodiment, the first group of socket plugs identifies tool sockets used with a socket drive having a first size, and the second group of socket plugs identifies tool sockets used with a socket drive having a second size.

According to a further aspect of the invention, a method is provided for identifying a set of tool sockets of various sizes. The method includes providing a plurality of socket plugs of various sizes, selecting one of the plurality of socket plugs, and inserting the socket plug into a corresponding one of the set of tool sockets. Each of the plurality of socket plugs includes a body and an identifier disposed on the body to identify the size of one of the tool sockets. A socket plug is selected that corresponds in size to one of the tool sockets. A user continues selecting and inserting the socket plugs into the corresponding sized tool sockets until each of the set of tool sockets is identified with one of the socket plugs.

In an illustrative embodiment, the plurality of socket plugs is provided in a first group of socket plugs and a second group of socket plugs. The first group of socket plugs identifies a first group of tool sockets adapted for use with a first socket drive having a first size, and the second group of socket plugs identifies a second group of tool sockets adapted for use with a second socket drive having a second size. The first group of socket plugs can be provided in a first color, and the second group of socket plugs can be provided in a second color that is different from the first color. Groups of socket plugs having different colors can be provided to distinguish between sockets in U.S. customary units and metric units.

BRIEF DESCRIPTION OF THE DRAWINGS

It is to be understood that the drawings are for the purpose of illustration only and are not intended as a definition of the limits of the invention. The foregoing and other objects and advantages of the present invention will become apparent with reference to the following detailed description when taken in conjunction with the following drawings in which.

DETAILED DESCRIPTION OF THE INVENTION

Figure 1:
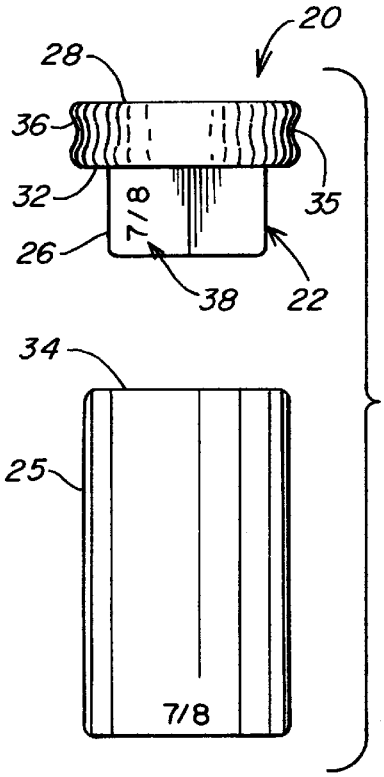
FIG. 1 is a schematic illustration of a socket plug of the present invention that is aligned to be mated with a tool socket.
Figure 2:
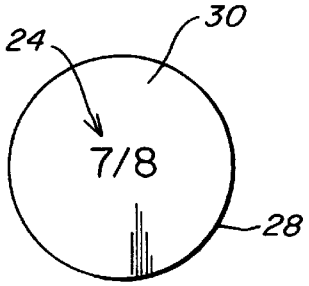
FIG. 2 is a top view of the socket plug of FIG. 1.
Figure 3:
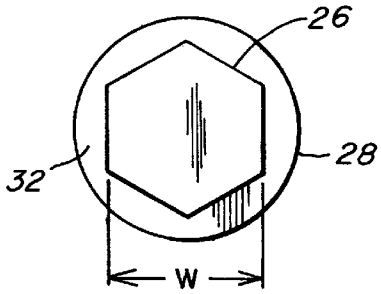
FIG. 3 is a bottom view of the socket plug of FIG. 1.

The present invention is directed to a tool socket identification device which can be mated with a tool socket to identify the particular size of the socket. As shown in FIGS. 1–3, an illustrative embodiment of the identification device is a socket plug 20 which includes a body 22 and an identifier 24 disposed on the body 22 so that the identifier 24 can be viewed when the socket plug 20 is mated with a tool socket 25. The body 22 includes a plug portion 26, which is configured to be inserted into the tool socket 25, and a cap 28 attached to one end of the plug portion 26. The cap 28 is configured to protrude from the tool socket. The identifier 24 is disposed on a face 30 of the cap opposite the plug portion 26 of the body 22. The identifier 24 is preferably relatively large to be easily viewed by a user, even in poor light, and may be of a contrasting color from the cap or otherwise formed to enhance visibility. The identifier may also be raised from the face 30 for use by the visually impaired or for other appropriate uses. The cap 28 is configured and attached to the plug portion 26 so as to form a shoulder 32 for engaging the rim 34 of the tool socket 25 and to thereby limit the depth of insertion of the plug portion 26 into the tool socket.

As best shown in FIG. 3, the plug portion 26 has a hexagonal shape which can be inserted in both 6-point and 12-point sockets. The plug portion 26 should be sized to be approximately equal to the size of the particular socket with which it is to be mated. For example, the plug portion 26 should have a width W across the flats of the plug portion 26 of approximately ⅞ inches for insertion into a ⅞ inch socket. Preferably, the width W of the plug portion 26 is slightly larger than the size of the tool socket so as to create a slight interference fit between the plug portion 26 and the socket. A slight interference fit ensures that the socket plug 20 will be retained within the tool socket 25 when used to identify the particular tool socket. The width W, however, should not be so large as to make the socket plug 20 difficult to insert or remove. It is to be appreciated that the plug portion 26 could be configured to have other shapes such as a 12-point shape.

Preferably, the cap 28 has a circular shape with a diameter that is approximately equal to the outer diameter of the tool socket so that a set of tool sockets can be stored in a fairly compact volume. However, for small tool socket sizes, the cap diameter may exceed the tool socket diameter so that the particular identifier disposed on the cap can have a size that is easily viewable by a user when the socket plug is mated with the tool socket. Preferably, the side wall 35 of the cap 28 is formed so as to provide a finger grip which the user can easily grasp for inserting and removing the socket plug 20 into and from the tool socket. As shown in FIG. 1, the side wall 35 can have a curved shape which forms a lip 36 that can be grasped by a user. Alternatively, the side wall 35 can be knurled in one of various patterns to provide a gripping surface. It is to be appreciated, however, that other means can be utilized to provide a finger grip for the cap, and such means are intended to be within the scope of the invention.

The identifier 24 is preferably formed with raised characters as an integral part of the cap 28. Preferably, the identifier 24 is configured as a fractional unit when designating the size of the socket in inches and a whole number unit when designating the size of the socket in millimeters. However, other forms of identification could be included with the identifier. For example, "in" can be included as part of the identifier to specify the size of the tool socket as being in units of inches, and "mm" can be included as part of the identifier to specify the size of the tool socket as being in millimeters. In addition to the identifier 24 disposed on the face 30 of the cap 28, a similar identifier 38 can be disposed on one of the flats of the hexagonal plug portion 26 (FIG. 1) to further aid the user in selecting the proper socket plug 20 to identify a particular tool socket. It is to be appreciated that the identifier could be a separate label that is attached to the cap, and the identifier could have a color that contrasts with the cap.

Preferably, each socket plug 20 is molded from a plastic material using a molding process generally known in the art (for example, injection molding). The material should be capable of withstanding the wear and tear and the contaminants typically associated with the environments in which socket wrenches are used such as garages, machine shops, factories, and the like. The material should be nonsoluable and resistant to solvents, grease, oil, and the like. The body 22 can be formed either as a solid body or a hollow body. It is to be appreciated that the body 22 could be formed from other materials such as fiberglass, metals, rubber and the like. In particular, the body 22 could be made from a magnetic material so that it could be attached to a metal surface when not being used or even attached to a tool socket using magnetic forces.

Figure 4:
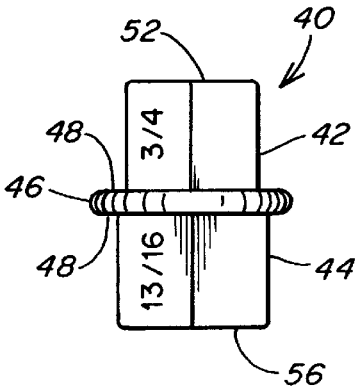
FIG. 4 is a side elevational view of another embodiment of a socket plug of the present invention.
Figure 5:
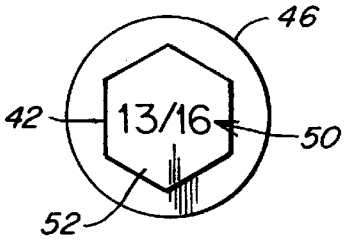
FIG. 5 is a top view of the socket plug of FIG. 4.
Figure 6:
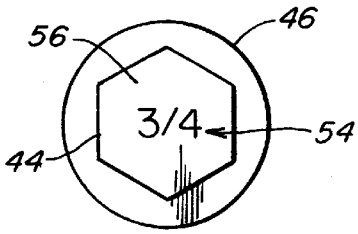
FIG. 6 is a bottom view of the socket plug of FIG. 4.

Another illustrative embodiment for a socket plug is shown in FIGS. 4–6. The socket plug 40 of this embodiment includes a first plug portion 42, a second plug portion 44 and a flange 46 disposed between the first and second plug portions 42, 44. The first and second plug portions extend away from each other from opposite sides of the flange 46, and a shoulder 48 is formed between each of the plug portions 42, 44 and the respective sides of the flange 46. Similar to the cap 28 described above, the flange 46 controls the depth of insertion of each of the plug portions 42, 44 into a tool socket. Preferably, the first and second plug portions 42, 44 are formed to have a hexagonal shape corresponding to the size of the particular socket into which it is to be inserted. The first and second plug portions 42, 44 can be formed to each have the same size so that a user can insert either portion into the same socket. Alternatively, the first and second plug portions 42, 44 can have different sizes so that the socket plug 40 can be used to identify two tool sockets of different sizes. When the socket plug 40 is mated with a tool socket, one of the first and second plug portions 42, 44 will protrude from the socket and can be used as a finger grip.

Preferably, a separate identifier is disposed on each end of the first and second plug portions 42, 44 to identify the size of the opposite plug portion. For example, as illustrated in FIG. 5, the identifier 50 disposed on the end 52 of the first plug portion 42 identifies the size of the second plug portion 44. Similarly, as illustrated in FIG. 6, the identifier 54 disposed on the end 56 of the second plug portion 44 identifies the size of the first plug portion 42.

Generally, a user is provided with a set of socket plugs which includes a plurality of socket plugs having a range of sizes. The user selects one of the socket plugs corresponding in size to a tool socket the user wishes to identify. The socket plug is then inserted into the tool socket so that the identifier, which identifies the size of the tool socket, is viewable for subsequent identification purposes. The user continues to select and insert a socket plug into each tool socket that is to be identified. When the user later wishes to use a particular sized tool socket, the user can easily view the identifiers and select the desired tool socket at which time the socket plug is removed from the tool socket. When that particular tool socket is no longer required, the user merely reinserts the socket plug in the tool socket for future identification.

It is to be appreciated that the socket plugs of the present invention can be produced in various colors as an additional means of identifying tool sockets. One particular situation in which different colored socket plugs may be beneficial for identification purposes arises when a set of socket wrenches includes separate groups of tool sockets for use with socket wrenches having socket drives of different sizes. For example, a first set of socket plugs having a first color can be used to identify tool sockets configured for a wrench having a ¼ inch drive, and a second set of socket plugs having a second color can be used to identify tool sockets configured for a wrench having a ⅜ inch drive. Similarly, socket plugs could be provided in a third color to identify tool sockets configured for a wrench having a ½ inch drive. Different colors could also be used to distinguish between sockets in U.S. customary units (inches) and metric units.

Having described several illustrative embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is limited only as defined in the following claims and the equivalents thereto.

What is claimed is:

1. A tool socket plug for identifying a tool socket, the tool socket having a work engaging cavity with a socket size at a first end thereof and a socket drive engaging aperture at a second end thereof that is adapted to receive a socket drive to rotate the tool socket, the tool socket plug comprising:

a body including a noncircular first end portion and a close-ended circular second end portion, wherein the first end portion is removably engagable with the work engaging cavity, and the second end portion is adapted to protrude from the tool socket when the first end portion is engaged with the work engaging cavity, the second end portion including a shoulder that engages the tool socket when the first end portion is fully engaged with the work engaging cavity; and at least one identifier disposed on at least the second end portion, the at least one identifier including a size indicia corresponding to the socket size of the tool socket and being viewable when the first end portion is engaged with the work engaging cavity.

2. The tool socket plug recited in claim 1, wherein the at least one identifier is raised from a surface of the second end portion.

3. The tool socket plug recited in claim 1, wherein the first end portion has a cross-sectional size that is substantially equal to the size of the tool socket.

4. The tool socket plug recited in claim 1, wherein the first end portion has a cross-sectional size that is slightly larger than the size of the tool socket to create an interference fit between the first end portion and the tool socket.

5. The tool socket plug recited in claim 1, wherein the second end portion includes a finger grip.

6. The tool socket plug recited in claim 1, wherein the second end portion is a cap, the first end portion being attached to one side of the cap and the identifier being disposed on an opposite side of the cap.

7. The tool socket plug recited in claim 1, wherein the at least one identifier is integrally formed on at least the second end portion.

8. The tool socket plug recited in claim 1, wherein the at least one identifier includes a label.

9. The tool socket plug recited in claim 1, wherein the first end portion has a multisided cross-section.

10. The tool socket plug recited in claim 1, wherein the first end portion has a hexagonal cross-section.

11. A tool socket plug for identifying a tool socket having a work engaging cavity with a socket size at a first end thereof and a socket drive engaging aperture at a second end thereof that is adapted to receive a socket drive to rotate the tool socket, the tool socket plug comprising:

a body including a first end portion, a second end portion and a flange disposed between the first end portion and the second end portion, each of the first end portion and the second end portion being removably engagable with the work engaging cavity of a tool socket, at least one of the first and second end portions being close-ended, the first end portion and the second end portion each having a cross-sectional shape, the cross-sectional shape of the first end portion being the same as the cross-sectional shape of the second end portion, the second end portion adapted to protrude from the tool socket when the first end portion is inserted into the work engaging cavity of the tool socket; and at least one identifier disposed on at least the second end portion, the at least one identifier including a size indicia corresponding to the socket size of the tool socket and being viewable when the first end portion is inserted into the work engaging cavity of the tool socket.

12. The tool socket plug recited in claim 11, wherein the cross-sectional shape of each of the first end portion and the second end portion is hexagonal.

13. The tool socket plug recited in claim 12, wherein the first end portion and the second end portion each has a cross-sectional size, the cross-sectional size of the first end portion being equal to the cross-sectional size of the second end portion.

14. The tool socket plug recited in claim 12, wherein the first end portion and the second end portion each has a cross-sectional size, the cross-sectional size of the first end portion being different from the cross-sectional size of the second end portion.

15. The tool socket plug recited in claim 11, wherein the at least one identifier includes a first identifier and a second identifier, the first identifier being disposed on an end of the first end portion opposite the flange, the second identifier being disposed on an end of the second end portion opposite the flange.

16. A set of socket plugs for identifying a set of tool sockets, each of the tool sockets having a work engaging cavity with a socket size at a first end thereof and a socket drive engaging aperture with a drive aperture size at a second end thereof that is adapted to receive a socket drive to rotate the tool socket, the work engaging cavities of the tool sockets being of various sizes, the set of socket plugs comprising:

a plurality of socket plugs, each socket plug of the plurality of socket plugs including a body that is adapted to be mated with the work engaging cavity of a corresponding tool socket of the set of tool sockets, an identifier corresponding to the socket size of the corresponding tool socket that is disposed on the body to be viewable when the socket plug is mated with the corresponding tool socket, and a color corresponding to the drive aperture size of the corresponding tool socket;

wherein the plurality of socket plugs includes a first group of socket plugs having a first color corresponding to a first drive aperture size and a second group of socket plugs having a second color corresponding to a second drive aperture size, the first color being different from the second color.

17. The set of socket plugs recited in claim 16, wherein the first group of socket plugs corresponds to a first group of tool sockets that is adapted for use with a first socket drive having a first size, and the second group of socket plugs corresponds to a second group of tool sockets that is adapted for use with a second socket drive having a second size.

18. A method for identifying a set of tool sockets of various sizes, each tool socket having a work engaging cavity with a socket size at a first end thereof and a socket drive engaging aperture at a second end thereof that is adapted to receive a socket drive to rotate the tool socket, the method comprising the steps of:

(A) providing a plurality of socket plugs of various sizes, each of the plurality of socket plugs including a body and an identifier to identify the socket size of one of the set of tool sockets, the body including a first end portion removably engagable with the work engaging cavity of a tool socket and a close-ended second end portion that is adapted to protrude from the tool socket when the first end portion is engaged with the work engaging cavity, the identifier being disposed on the second end portion, the plurality of socket plugs including a first group of socket plugs having a first color and a second group of socket plugs having a second color that is different from the first color, the first group of socket plugs corresponding to a first group of tool sockets having a socket drive engaging aperture with a first size, the second group of socket plugs corresponding to a second group of tool sockets having a socket drive engaging aperture with a second size that is different from the first size;

(B) selecting one of the plurality of socket plugs corresponding in size to the one of the set of tool sockets; and (C) inserting the first end portion of the one of the plurality of socket plugs into the work engaging cavity of the one of the set of tool sockets to identify the socket size of the tool socket.

19. The method recited in claim 18, further comprising the step of repeating steps (B) and (C) until each of the set of tool sockets is identified with one of the plurality of socket plugs.

20. A tool socket plug for identifying a tool socket, the tool socket having a work engaging cavity with a socket size at a first end thereof and a socket drive engaging aperture at a second end thereof that is adapted to receive a socket drive to rotate the tool socket, the tool socket plug comprising:

a body including a first end portion and a second end portion, the first end portion being removably engagable with the work engaging cavity and the second end portion adapted to protrude from the tool socket when the first end portion is engaged with the work engaging cavity, the first end portion and the second end portion each having a cross-sectional shape with a cross-sectional size, the cross-sectional shape of the first end portion being the same as the cross-sectional shape of the second end portion, the cross-sectional size of the first end portion being different from the cross-sectional size of the second end portion; and at least one identifier disposed on at least the second end portion, the at least one identifier including a size indicia corresponding to the socket size of the tool socket and being viewable when the first end portion is engaged with the work engaging cavity.

21. The tool socket plug recited in claim 20, wherein the cross-sectional shape of each of the first and second end portions is hexagonal.

* * * * *